US011903423B2

(12) United States Patent
Qiu et al.

(10) Patent No.: US 11,903,423 B2
(45) Date of Patent: Feb. 20, 2024

(54) ATOMIZER AND ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Hengcong Su, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 534 days.

(21) Appl. No.: 17/197,076

(22) Filed: Mar. 10, 2021

(65) Prior Publication Data

US 2021/0282462 A1 Sep. 16, 2021

Related U.S. Application Data

(63) Continuation of application No. PCT/CN2019/104758, filed on Sep. 6, 2019.

(30) Foreign Application Priority Data

Sep. 10, 2018 (CN) ..... 201821477370.4

(51) Int. Cl.
*A24F 40/485* (2020.01)
*A24F 40/46* (2020.01)

(52) U.S. Cl.
CPC ..... *A24F 40/485* (2020.01); *A24F 40/46* (2020.01)

(58) Field of Classification Search
CPC ..... A24F 40/485; A24F 40/46; A24F 40/20; A24F 40/40
See application file for complete search history.

(56) References Cited

U.S. PATENT DOCUMENTS

2016/0309789 A1 10/2016 Thomas
2018/0084832 A1* 3/2018 Li ..... B05B 12/081
(Continued)

FOREIGN PATENT DOCUMENTS

CN 206227718 A 6/2017
CN 206603235 U 11/2017
(Continued)

OTHER PUBLICATIONS

The extended European Search Report of EP Application No. 19858865.9 dated May 9, 2022.

*Primary Examiner* — Jean F Duverne
(74) *Attorney, Agent, or Firm* — Andrew C. Cheng

(57) ABSTRACT

An atomizer includes a housing, an atomizing assembly and a movable assembly. The housing defines a mounting opening. The atomizing assembly includes an inner tube detachably mounted in the housing through the mounting opening. The inner tube is provided with a smoke outlet. The movable assembly includes a dustproof cover movably disposed on the housing and a locking member. The dustproof cover is rotatable relative to the locking member, rotating the dustproof cover can open the mounting opening to expose the smoke outlet or close the mounting opening to cover the smoke outlet. The inner tube is provided with a locking groove engaged with the locking member. When the dustproof cover opens the mounting opening and the dustproof cover is caused to slide, the locking member moves under the driving of the dustproof cover to disengage from the locking groove, such that the inner tube can be taken out.

20 Claims, 8 Drawing Sheets

(56) References Cited

U.S. PATENT DOCUMENTS

| | | | | |
|---|---|---|---|---|
| 2019/0150509 | A1* | 5/2019 | Qiu | H01M 50/202 |
| 2019/0307174 | A1* | 10/2019 | Qiu | B67D 7/0288 |
| 2019/0335813 | A1* | 11/2019 | Qiu | A24F 40/485 |

FOREIGN PATENT DOCUMENTS

| | | | |
|---|---|---|---|
| CN | 206687168 | U | 12/2017 |
| CN | 207075562 | A | 3/2018 |
| CN | 208941050 | U | 6/2019 |
| WO | 2017194751 | A1 | 11/2017 |

* cited by examiner

ATOMIZER AND ELECTRONIC CIGARETTE

CROSS-REFERENCE TO RELATED APPLICATIONS

This application is a continuation-in-part of International Patent Application No. PCT/CN2019/104758, filed on Sep. 6, 2019, entitled "atomizer and electronic cigarette", which claims priority to Chinese Patent Application No. 201821477370.4, filed on Sep. 10, 2018. All of the aforementioned patent applications are hereby incorporated by reference in their entireties.

TECHNICAL FIELD

The present disclosure relates to the technical field of simulated smoking, and more particularly, relates to an atomizer and an electronic cigarette having the atomizer.

BACKGROUND

The electronic cigarette includes an atomizer and a power device electrically connected to the atomizer. In use, the power device supplies power to the atomizer, so that the smoking material is heated and atomized to generate smoke, and the user inhales the smoke through the smoke outlet provided at the atomizer.

Normally, the smoke outlet is always exposed to the outside environment, and it is inevitable that dust will fall into the atomizer through the smoke outlet, and the user's inhalation of the dust may affect the health of the user. At the same time, after heating and atomization, the smoking material is easy to produce impurities, and the impurities remain in the atomizer. If they are not cleaned in time, they will produce peculiar smell after repeated heating, which will affect the user's taste. Since the structure of the current atomizer is relatively complicated, many parts and components need to be disassembled to clean up the impurities, which brings inconvenience to the user's cleaning work.

SUMMARY

Based on the above, it is necessary to provide an atomizer that is dust-proof and easy to clean up impurities.

It is also necessary to provide an electronic cigarette having the atomizer.

The technical solution adopted by the present disclosure to solve its technical problems is as follows.

An atomizer includes a housing, an atomizing assembly mounted in the housing and a movable assembly mounted to the housing. The housing defines a mounting opening. The atomizing assembly includes an inner tube detachably mounted in the housing through the mounting opening. The inner tube is provided with a smoke outlet. The movable assembly includes a dustproof cover movably disposed on the housing and a locking member. The dustproof cover is rotatable relative to the locking member, rotating the dustproof cover can open the mounting opening to expose the smoke outlet or close the mounting opening to cover the smoke outlet. The inner tube is provided with a locking groove engaged with the locking member. When the dustproof cover opens the mounting opening and the dustproof cover is caused to slide, the locking member moves under the driving of the dustproof cover to disengage from the locking groove, such that the inner tube can be taken out from the housing.

In one embodiment, the housing includes an upper cover, the mounting opening is defined in the upper cover. The upper cover further includes a guiding groove, a connecting column is formed by extending downward from the lower surface of the dustproof cover. The connecting column extends through the guiding groove and is slidable in the guiding groove.

In one embodiment, the lower surface of the upper cover extends downward to form a baffling plate located at one side of the guiding groove away from the mounting opening. The locking member is a deformable member. One end of the locking member is protruded to provide an abutting portion capable of abutting against the baffling plate. The locking member is provided with a deformation groove adjacent to the abutting portion.

In one embodiment, the movable assembly further includes a rotating member and a torsion spring. The connecting column extends through the guiding groove and the locking member in sequence and then connects with the rotating member. The rotating member includes a boss located between two torsion arms of the torsion spring. The boss has a substantially waist-shaped structure, the boss has two oppositely arranged side planes and two oppositely arranged arc surfaces, the two torsion arms of the torsion spring are arranged parallel to the side planes.

In one embodiment, the lower surface of the upper cover extends downward to form a fixing column. The torsion spring is sleeved on the fixing column. The movable assembly further includes a spring member sleeved on the fixing column. The rotating member further includes a base seat connected to the boss, and the base seat abuts against the spring member.

In one embodiment, the lower surface of the upper cover extends downward to form a connecting pipe that is open at both ends. The upper end of the connecting pipe extends through the upper surface of the upper cover, and the mounting opening is formed by the opening of the upper end of the connecting pipe. The locking member extends through the connecting pipe to be engaged in the locking groove.

In one embodiment, the inner wall of the connecting pipe protrudes inwardly along the radial direction of the connecting pipe to form a first abutting edge, the upper end of the inner tube protrudes outwardly along the radial direction of the inner tube to form a second abutting edge, and the second abutting edge abuts against the first abutting edge. The locking groove is defined at the outer side wall of the second abutting edge along the radial direction of the inner tube.

In one embodiment, the atomizing assembly further includes a heating member. The inner tube is provided with an atomizing chamber. The atomizing chamber is in communication with the smoke outlet. The heating member is at least partially received in the atomizing chamber.

In one embodiment, the housing further includes an outer casing, the upper cover is detachably provided at one end of the outer casing, and a partition member is mounted in the outer casing. The atomizing assembly further includes an outer tube and an elastic member. The outer tube is clamped between the partition member and the first abutting edge. The inner tube is movably received in the outer tube. The side wall of the outer tube is provided with a sliding slot along the axial direction of the outer tube, and a clamping protrusion is provided at the side wall of the inner tube. The clamping protrusion is slidably received in the sliding slot. The elastic member is compressible and located between the clamping protrusion and the partition member.

An electronic cigarette includes any one of the above atomizers.

The beneficial effects of the present disclosure are:

In the present disclosure, the inner tube can be closed by rotating the dustproof cover to prevent dust, or the inner tube can be opened by rotating the dustproof cover so that the user can inhale the smoke. When the inner tube is opened, sliding the dustproof cover can release the locking relationship between the locking member and the inner tube, and then the inner tube can be taken out, which is convenient for the user to clean up impurities and is simple to operate, and it ensures the taste of smoking and improves the user experience.

BRIEF DESCRIPTION OF THE DRAWINGS

Exemplary embodiments of the disclosure are described more fully hereinafter with reference to the accompanying drawings.

Figure 1:
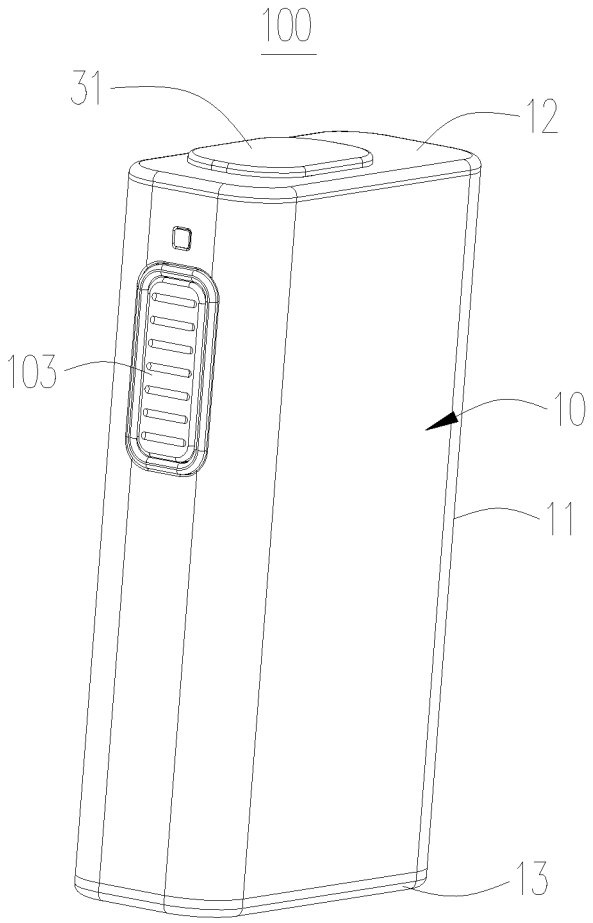
FIG. 1 is a schematic diagram of the three-dimensional structure of the electronic cigarette of the present disclosure (the dustproof cover is in the state of closing the mounting opening)

The following table list various components and reference numerals thereof.

DETAILED DESCRIPTION OF PREFERRED EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant features being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/".

Figure 2:
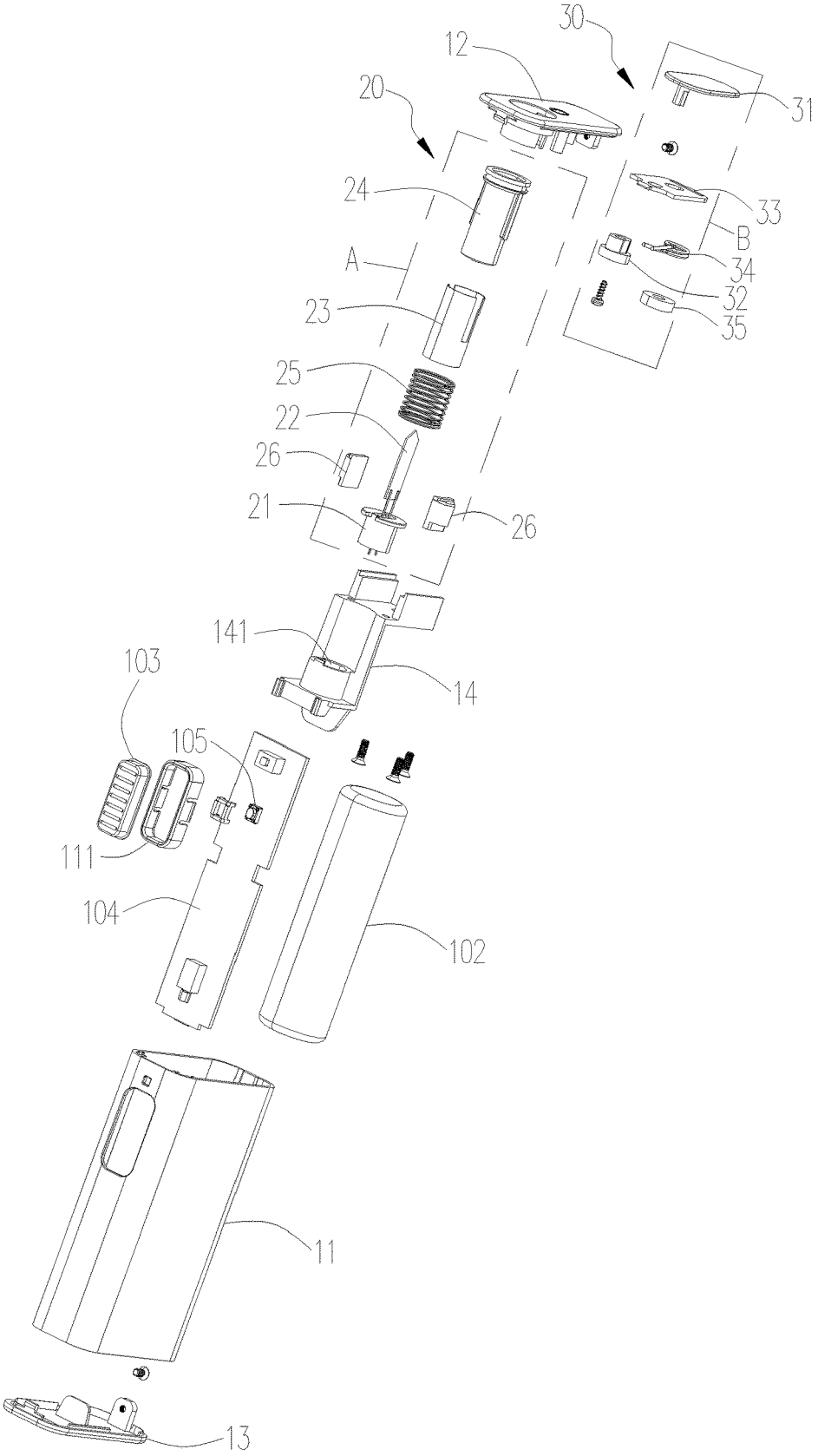
FIG. 2 is an exploded view of the electronic cigarette shown in FIG. 1.

Please refer to FIGS. 1 and 2, the present disclosure provides an electronic cigarette 100, which includes an atomizer (not labelled in the figure) and a power supply device 102 electrically connected to the atomizer. The atomizer includes a housing 10, an atomizing assembly 20 and a movable assembly 30 mounted in the housing 10. In use, the power supply device 102 supplies power to the atomizing assembly 20, thereby converting the smoking substance stored in the atomizing assembly 20 into smoke by means of heating for the user to inhale.

| | | |
|---|---|---|
| Electronic Cigarette 100 | Power supply device 102 | Lighting button 103 |
| Control board 104 | Switch 105 | Housing 10 |
| Outer casing 11 | Limiting member 111 | Upper cover 12 |
| Connecting pipe 121 | Mounting opening 1211 | First abutting edge 1212 |
| Guiding groove 122 | Fixing column 123 | Lower cover 13 |
| Partition member 14 | Mounting groove 141 | Atomizing assembly 20 |
| Atomizing base 21 | Heating member 22 | Outer tube 23 |
| Sliding slot 231 | Inner tube 24 | Atomizing chamber 241 |
| Smoke outlet 244 | Second abutting edge 242 | Clamping protrusion 243 |
| Locking groove 245 | Elastic member 25 | Clamping member 26 |
| Movable assembly 30 | Dustproof cover 31 | Connecting column 311 |
| Rotating member 32 | Base seat 321 | Boss 322 |
| Side plane 3221 | Arc surface 3222 | Locking member 33 |
| Abutting portion 331 | Deformation groove 332 | Torsion spring 34 |
| Spring member 35 | Baffling plate 124 | Convex portion 261 |
| Concave portion 211 | | |

The housing 10 includes an outer casing 11, an upper cover 12 detachably mounted at one end of the outer casing 11, and a lower cover 13 detachably mounted at the other end of the outer casing 11 opposite to the upper cover 12.

Figure 8:
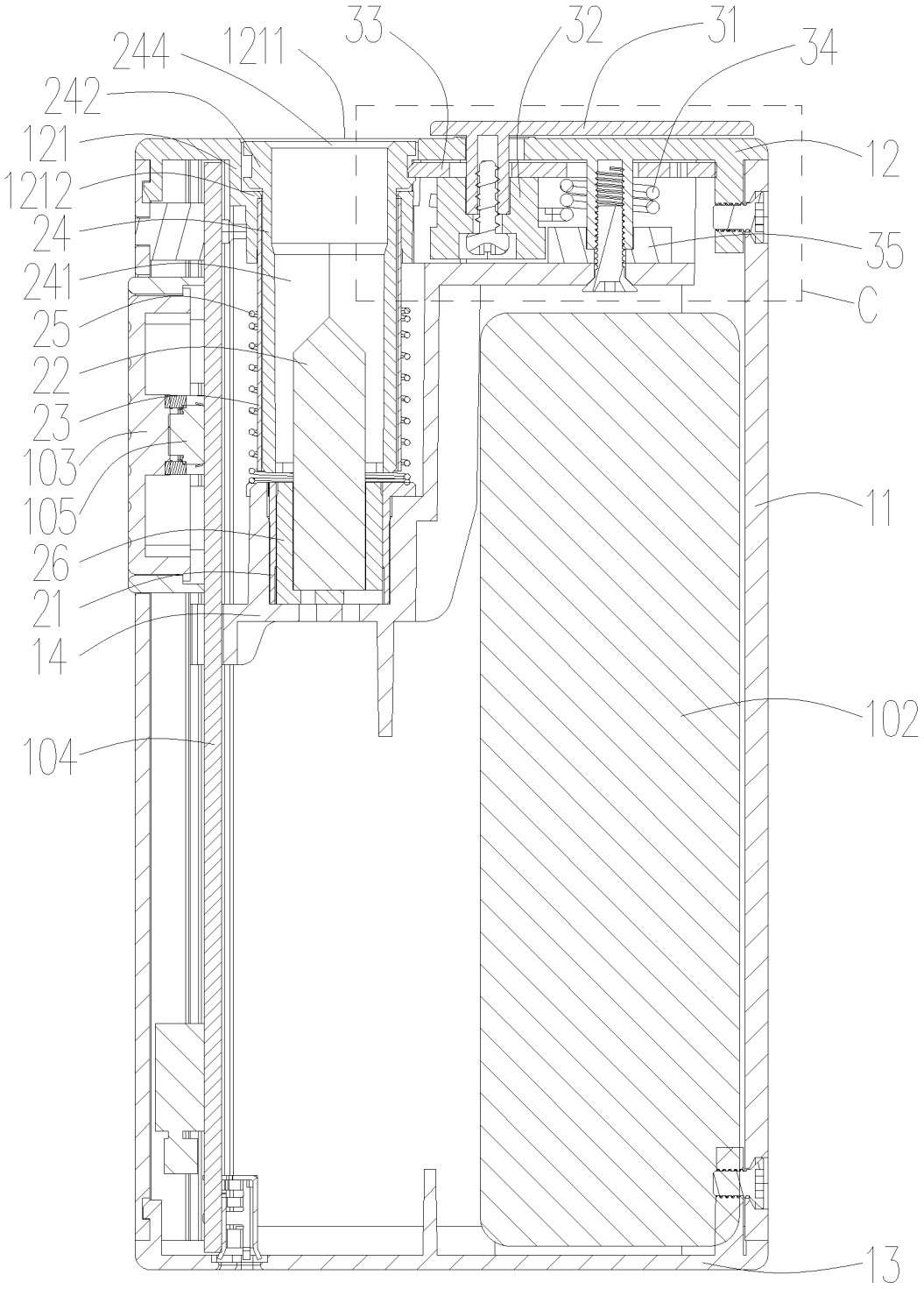
FIG. 8 is a cross-sectional view of the electronic cigarette shown in FIG. 1 (the dustproof cover is in the state of opening the mounting opening)

Please refer to FIG. 8, specifically, the outer casing 11 has a hollow cylindrical structure with openings at the upper and lower ends. The upper cover 12 is arranged at the upper end of the outer casing 11, the lower cover 13 is arranged at the lower end of the outer casing 11, so that the outer casing 11, the upper cover 12 and the lower cover 13 jointly form a box-shaped structure with a cavity therein. A partition member 14 is mounted in the outer casing 11 to divide the cavity into two chambers (not labelled in the figure), the atomizing assembly 20 is mounted in one of the chambers, the power supply device 102 is mounted in the other chamber, so that the power supply device 102 is at least partially located at one side of the atomizing assembly 20, the overall height of the electronic cigarette 100 is reduced, which is convenient for the user to use and carry. In the embodiment, the partition member 14 is detachably connected to the upper cover 12 by screws.

Figure 4:
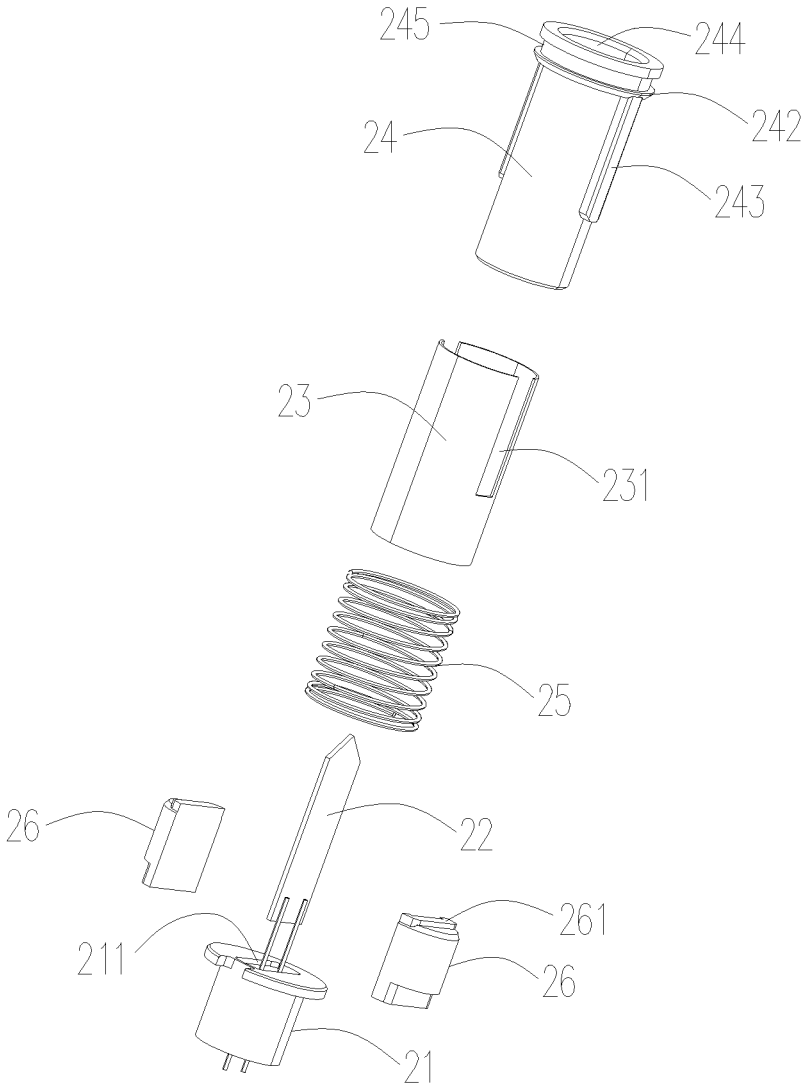
FIG. 4 is a partially enlarged view of the portion A of the electronic cigarette shown in FIG. 2.

Please refer to FIGS. 4 and 8, the atomizing assembly 20 includes an atomizing base 21 mounted on the partition member 14, a heating member 22 mounted on the atomizing base 21, an outer tube 23 sleeved on the heating member 22, an inner tube 24 slidably received in the outer tube 23, and an elastic member 25 compressibly located between the partition member 14 and the inner tube 24.

Please refer to FIG. 2, the upper surface of the partition member 14 is provided with a mounting groove 141, and the atomizing base 21 is mounted in the mounting groove 141. In order to prevent the atomizing base 21 from rotating in the mounting groove 141, the upper surface of the partition member 14 is provided with a protrusion (not labelled in the figure), and the atomizing base 21 is provided with a cutout (not labelled in the figure) corresponding to the protrusion, the protrusion and the cutout are engaged with each other, so as to limit the position of the atomizing base 21.

Figure 3:
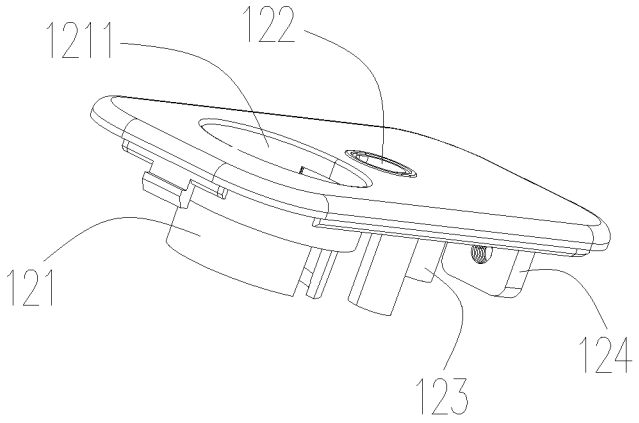
FIG. 3 is a schematic diagram of the structure of the upper cover of the electronic cigarette shown in FIG. 2.

Referring to FIGS. 3 and 8, the lower surface of the upper cover 12 extends downward to form a connecting pipe 121 that is open at both ends. The upper end of the connecting pipe 121 extends through the upper surface of the upper cover 12. The opening of the upper end of the connecting pipe 121 defines a mounting opening 1211, the inner wall of the connecting pipe 121 protrudes inwardly along the radial direction thereof to form a first abutting edge 1212. The outer tube 23 has a substantially cylindrical structure that is open at both ends. The upper end of the outer tube 23 abuts against the first abutting edge 1212, and the lower end of the outer tube 23 abuts against the partition member 14, so as to fix the outer tube 23.

The inner tube 24 is detachably mounted in the housing 10 through the mounting opening 1211, specifically, the inner tube 24 has a substantially cylindrical structure that is open at both ends. The inner cavity of the inner tube 24 forms an atomizing chamber 241, the opening of the upper end of the inner tube 24 forms a smoke outlet 244 in communication with the atomizing chamber 241. The heating member 22 is at least partially received in the atomizing chamber 241. The upper end of the inner tube 24 protrudes outward along the radial direction of the inner tube 24 to form a second abutting edge 242, the inner tube 24 is inserted into the outer tube 23 through the mounting opening 1211. The second abutting edge 242 abuts the first abutting edge 1212 to limit the inner tube 24 and prevent the inner tube 24 from moving downward relative to the outer tube 23.

Please refer to FIG. 4 again, the side wall of the outer tube 23 is provided with two sliding slots 231 along the axial direction of the outer tube 23. The outer wall of the inner tube 24 is provided with a clamping protrusion 243 along the axial direction of the inner tube 24 corresponding to each sliding slot 231, and the clamping protrusion 243 extends through the sliding slot 231 to the outside of the outer tube 23. Sliding the inner tube 24 can insert it into the outer tube 23 through the mounting opening 1211, or it can be taken out from the outer tube 23 through the mounting opening 1211, and the inner tube 24 slides along the sliding slots 231 during the sliding process of the inner tube 24. One end of the elastic member 25 elastically resists the clamping protrusions 243, the other end of the elastic member 25 elastically resists the partition member 14; thus, when the inner tube 24 is inserted into the outer tube 23, the elastic member 25 is compressed; when the locking force on the inner tube 24 is removed, the elastic member 25 restores, so that the inner tube 24 is ejected from the outer tube 23 and can be taken out.

In this embodiment, the elastic member 25 is a spring sleeved on the outer tube 23. It can be understood that, in other embodiments not shown, the elastic member 25 can also be a rigid and elastic element such as a stainless steel spring sheet or a copper spring sheet, which is not limited here.

In this embodiment, the atomizing assembly 20 further includes two clamping members 26 that are entangled with each other. The two clamping members 26 are oppositely clamped at both sides of the heating member 22 to fix the heating member 22. The two clamping members 26 are hugged and mounted in the atomizing base 21 to connect the heating member 22 and the atomizing base 21. There are two pins provided at the heating member 22 (not labelled in the figure), one of the pins is electrically connected to one of the positive electrode and the negative electrode of the power supply device 102, the other pin is electrically connected to the other electrode of the power supply device 102, so that the power supply device 102 can supply power to the heating member 22.

Please refer to FIG. 4, to prevent the clamping member 26 from rotating in the atomizing base 21, the clamping member 26 is provided with a convex portion 261, the upper surface of the atomizing base 21 is provided with a concave portion 211 corresponding to the convex portion 261, the concave portion 211 extends through the atomizing base 21. The convex portion 261 and the concave portion 211 are engaged with each other to limit the clamping member 26.

It can be understood that, the heating member 22 can be made of a metal conductive material with electrical resistance, such as nickel-chromium alloy, tungsten, steel, etc. In addition, the shape of the heating member 22 can be a sheet-like or rod-like structure, which is not limited here. Alternatively, in other embodiments not shown, the heating member 22 is made of conductive ceramics; specifically, the heating member 22 is made of aluminum nitride or aluminum oxide ceramic sheets embedded with tungsten paste, so that each part generates more uniform heat, and the temperature rise during heating conforms to the linear law, which is more conducive to atomizing the smoke liquid; at the same time, the conductive ceramic heating sheet has the beneficial effects of long life, recyclable, cleanable, reduced use cost, and environmental protection; in addition, the conductive ceramic heating sheet has a certain ability to store smoke liquid, which can reduce the dry burning of the atomizer 100.

In use, the smoking material (for example, tobacco, cut tobacco, smoke paste, smoke liquid, etc.) is filled into the atomizing chamber 241 through the smoke outlet 244; when the electronic cigarette 100 is triggered, the power supply device 102 supplies power to the heating member 22, and the heating member 22 generates heat to heat the smoking material, so that the smoking material is atomized to generate smoke, and the user inhales the smoke through the smoke outlet 244.

In addition, the inner tube 24 is made of thermal insulation material, or the outside of the inner tube 24 is provided with a thermal insulation layer, and the thermal insulation layer is made of thermal insulation material; therefore, the heat in the atomizing chamber 241 can be prevented from being dissipated, the heat utilization efficiency is improved; at the same time, the scalding of the user due to the excessively high temperature of the housing 10 is avoided. It can be understood that, the thermal insulation material includes, but is not limited to, mica, high temperature resistant silica gel, high temperature resistant rubber, and PEK (polyether ketone).

Please refer to FIG. 2 and FIG. 8, the electronic cigarette of the present disclosure also includes a lighting button 103 and a control board 104, a switch 105 is mounted at the control board 104, and the switch 105 is electrically connected to the power supply device 102. The lighting button 103 is a mechanical button and mounted at the outer casing 11. The user presses the lighting button 103 to make the lighting button 103 contact with the switch 105, so that the switch 105 can detect the cigarette lighter signal sent by the lighting button 103; at this time, the switch 105 controls the power supply device 102 to supply power to the heating member 22. When the user pressure at the lighting button 103 is released, the lighting button 103 and the switch 105 are changed from the state of contact with each other to the state of separation, so that the cigarette lighter signal sent by the lighting button 103 and detected by the switch 105 is interrupted, and the switch 105 controls the power supply device 102 to stop supplying power to the heating member 22.

In this embodiment, a limiting member 111 is mounted at the outer casing 11, the lighting button 103 is movably mounted in the limiting member 111, and an elastic element (not shown in the figures) is compressible and mounted between the lighting button 103 and the switch 105. Pressing the lighting button 103 can make the lighting button 103 compress the elastic element, so that the lighting button 103 is in contact with the switch 105. Releasing the pressing action on the lighting button 103 can make the lighting button 103 move under the restoring action of the elastic element to separate the lighting button 103 from the switch 105. It can be understood that, the elastic element is rubber or silicone. In addition, the control board 104 is engaged with the partition member 14 to realize the fixing function of the control board 104.

Figure 5:
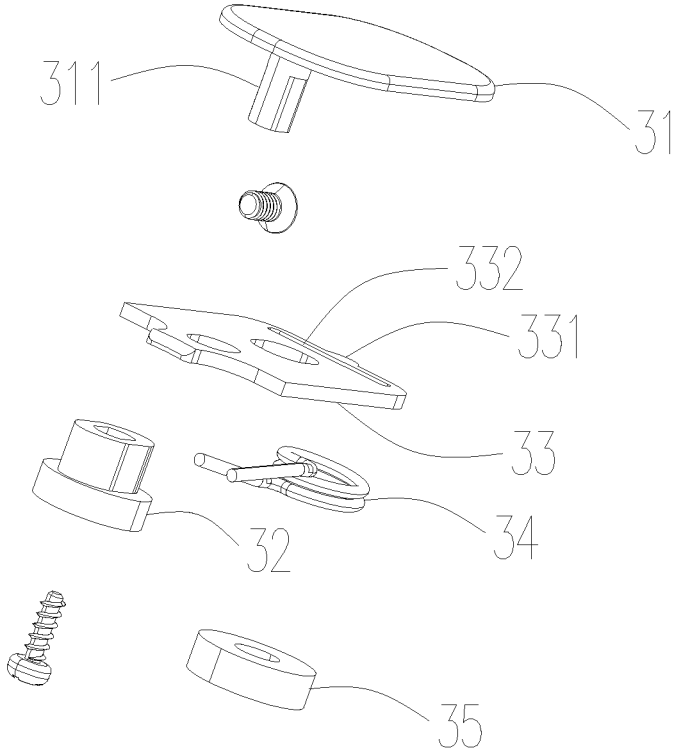
FIG. 5 is a partially enlarged view of the portion B of the electronic cigarette shown in FIG. 2.
Figure 9:
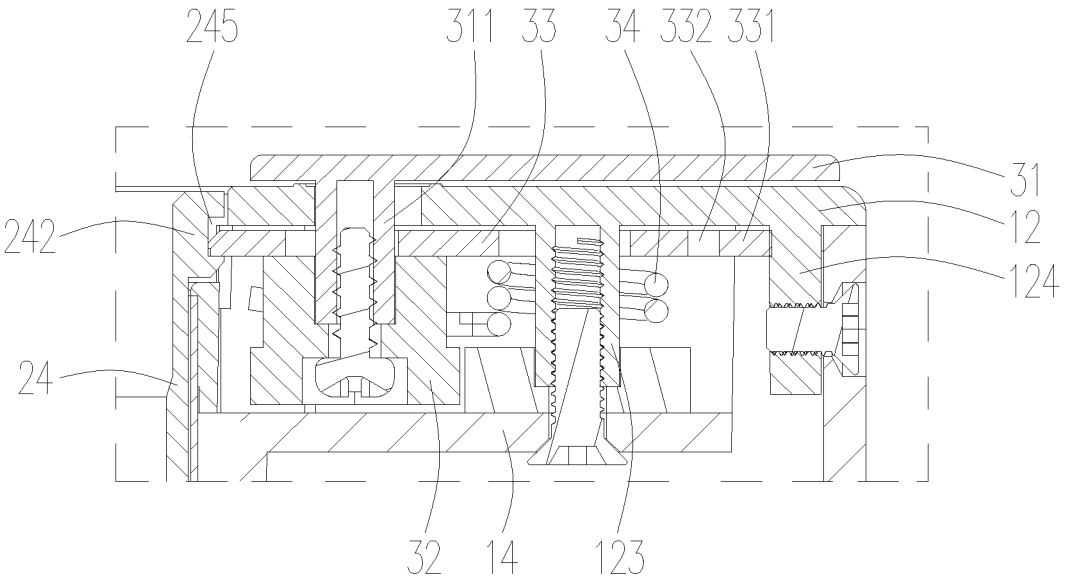
FIG. 9 is a partially enlarged view of the portion C of the electronic cigarette shown in FIG. 5.

Please refer to FIGS. 5, 8 and 9, the movable assembly 30 includes a dustproof cover 31 movably disposed on the upper surface of the upper cover 12, a rotating member 32 and a locking member 33 both housed in the housing 10, and a torsion spring 34 resisting the rotating member 32.

Specifically, the dustproof cover 31 has a substantially plate-shaped structure, a connecting column 311 is formed by extending downward from the lower surface of the dustproof cover 31, the connecting column 311 is eccentrically arranged, the upper cover 12 is provided with a guiding groove 122 for sliding the connecting column 311, the guiding groove 122 is located at one side of the mounting opening 1211, the connecting column 311 extends through the guiding groove 122 and the locking member 33 in sequence and then connects with the rotating member 32. The dustproof cover 31 and the rotating member 32 are rotatable relative to the locking member 33, sliding the dustproof cover 31 along the guiding groove 122 can make the locking member 33 and the rotating member 32 move away from or close to the connecting pipe 121 under the driving of the dustproof cover 31.

Please refer to FIGS. 4 and 9, the outer side wall of the second abutting edge 242 of the inner tube 24 is provided with a locking groove 245 along the radial direction of the inner tube 24, the locking member 33 is movably extending through the side wall of the connecting pipe 121 under the driving of the dustproof cover 31; thereby, the locking member 33 can be engaged in the locking groove 245, or the locking member 33 can be disengaged from the locking groove 245. It can be understood that, the locking groove 245 is located at the second abutting edge 242, which can ensure that the inner tube 24 has a high strength unimpeded by the locking groove 245. When the locking member 33 is engaged in the locking groove 245, the inner tube 24 is installed in place; at this time, the locking member 33 is in a locked state relative to the inner tube 24, and the axial freedom of the inner tube 24 is restricted and the inner tube 24 cannot be taken out. When the locking member 33 is disengaged from the locking groove 245, the locking state of the locking member 33 with respect to the inner tube 24 is released, and the inner tube 24 is ejected from the mounting opening 1211 under the restoring action of the elastic member 25.

Figure 10:
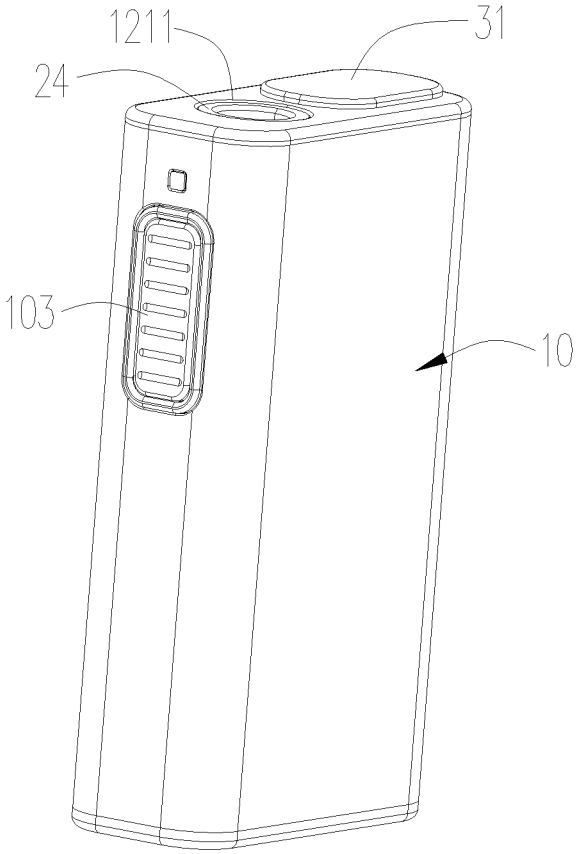
FIG. 10 is another three-dimensional structural diagram of the electronic cigarette shown in FIG. 1 (the dustproof cover is in the state of opening the mounting opening)
Figure 11:
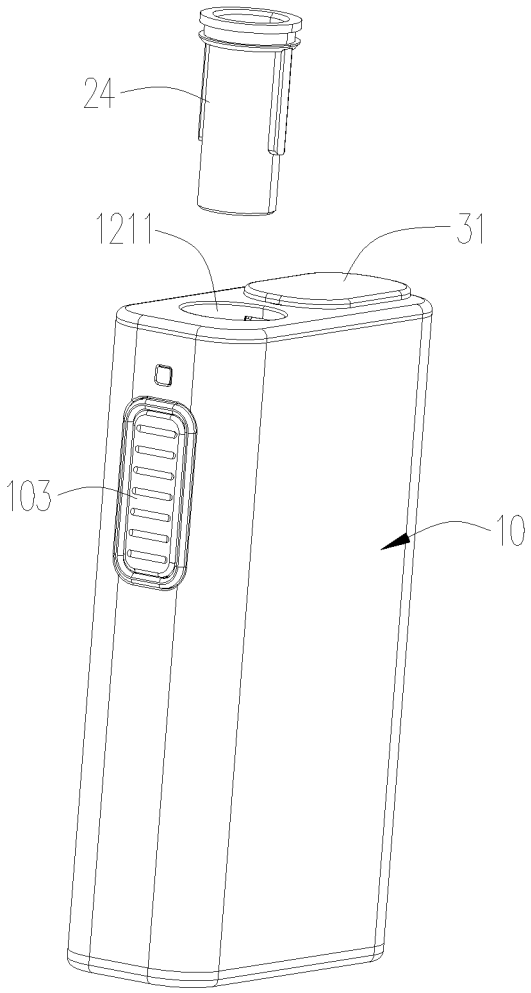
FIG. 11 is a further three-dimensional structural diagram of the electronic cigarette shown in FIG. 1 (with the inner tube taken out)

In addition, when the inner tube 24 is installed in place, the upper surface of the inner tube 24 is level with the upper surface of the upper cover 12 or lower than the upper surface of the upper cover 12; the user can rotate the dustproof cover 31 to close or open the mounting opening 1211. Referring to FIG. 1, when the dustproof cover 31 is rotated to close the mounting opening 1211, the inner tube 24 is covered by the dustproof cover 31, so that the smoke outlet 244 is isolated from the outside air under the covering action of the dustproof cover 31 to prevent dust in the outside air from entering the atomizing chamber 241 through the smoke outlet 244, and also prevent the user from inhaling dust and affecting health. Referring to FIG. 10, when the dustproof cover 31 is rotated to open the mounting opening 1211, the inner tube 24 is exposed; thus, the user can inhale the smoke through the smoke outlet 244. Please refer to FIG. 11, after the user finishes inhaling, some impurities remaining after the smoking material is heated and atomized will accumulate on the inner wall of the inner tube 24. When the mounting opening 1211 is completely opened by the dustproof cover 31, the locked state of the locking member 33 relative to the inner tube 24 can be released by sliding the dustproof cover 31 horizontally along the guiding groove 122 in a direction away from the mounting opening 1211, the inner tube 24 is ejected from the mounting opening 1211 under the restoring action of the elastic member 25 to take out the inner tube 24, thus the user can clean the impurities accumulated at the inner wall of the inner tube 24. It should be noted that, when the dustproof cover 31 closes the mounting opening 1211, even if the dustproof cover 31 is slid along the guiding groove 122, the mounting opening 1211 cannot be opened, and the inner tube 24 cannot be taken out; that is, only when the dustproof cover 31 is rotated until the mounting opening 1211 is fully opened, the locked state of the inner tube 24 can be released by sliding the dustproof cover 31, and then the inner tube 24 can be taken out, thus a safety protection function can be achieved for children, to prevent children from easily taking out the inner tube 24 and contacting the smoking substances.

Figure 6:
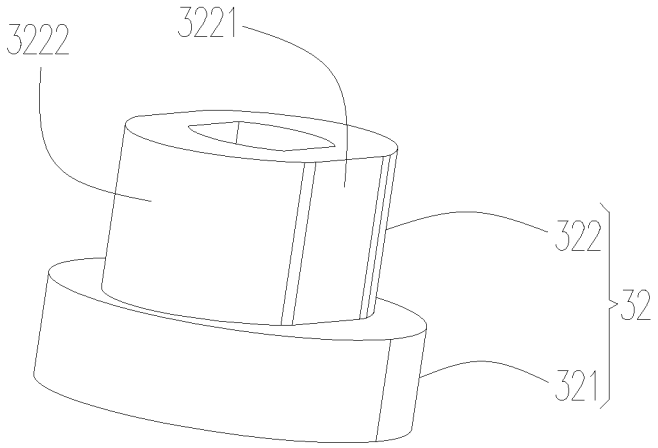
FIG. 6 is a schematic diagram of the structure of the rotating member of the movable assembly shown in FIG. 2.
Figure 7:
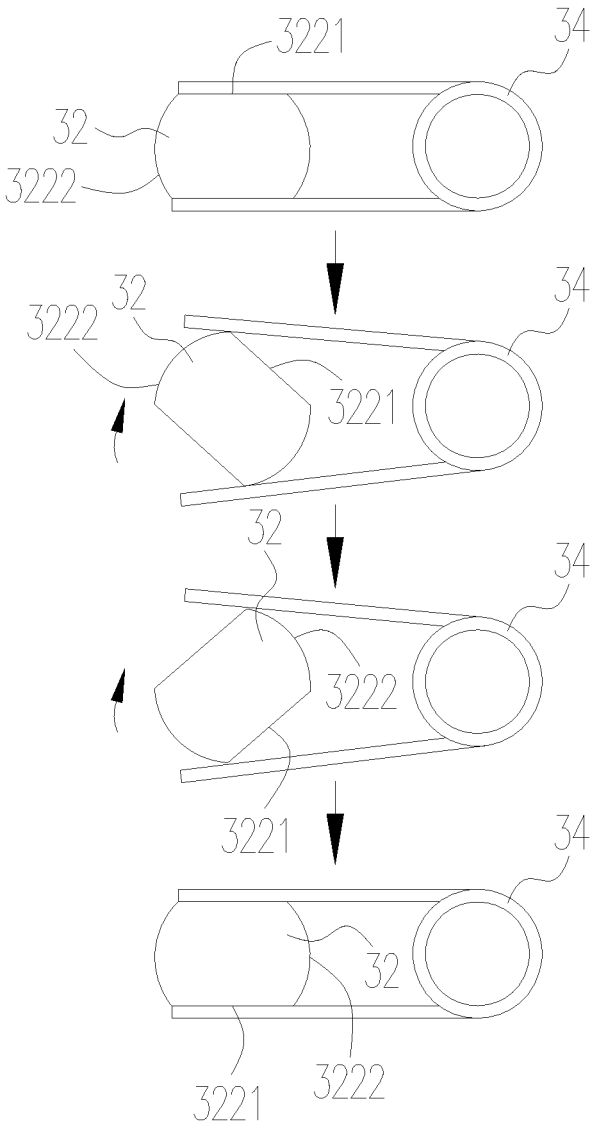
FIG. 7 is a schematic diagram of the cooperation relationship between the rotating member and the torsion spring of the movable assembly shown in FIG. 2 when the rotating member is rotated by 180°.

Referring again to FIGS. 3 and 9, the lower surface of the upper cover 12 extends downward to form a fixing column 123. Specifically, the partition member 14 is detachably connected to the fixing column 123 by screws. Please refer to FIGS. 6 and 7, the torsion spring 34 is sleeved on the fixing column 123, the two torsion arms of the torsion spring 34 are parallel to each other in a natural state. The rotating member 32 is connected to the connecting column 311 of the dustproof cover 31 by screws, the locking member 33 extends through the connecting column 311 and is movable relative to the connecting column 311. The rotating member 32 includes a base seat 321 and a boss 322 protruding from the upper surface of the base seat 321, the base seat 321 has a substantially cylindrical structure, the boss 322 has a substantially waist-shaped structure, the boss 322 has two oppositely arranged side planes 3221 and two oppositely arranged arc surfaces 3222, the two side planes 3221 are arranged parallel to each other and cooperate with the two torsion arms of the torsion spring 34. When the dustproof cover 31 is rotated until the mounting opening 1211 is closed, the two side planes 3221 are clamped between the two torsion arms, thereby preventing the dustproof cover 31 from shaking easily. When the user needs to open the mounting opening 1211, the dustproof cover 31 is rotated by 180°, the rotating member 32 rotates together under the driving of the dustproof cover 31; finally, the two side planes 3221 are clamped between the two torsion arms again, which also prevents the dustproof cover 31 from shaking easily. When the dustproof cover 31 starts to rotate, it needs to overcome the torsion force of the torsion spring 34 to rotate, and then gradually expands the two torsion arms; when the rotating member 32 rotates to the position where the torsion arm resists at the intersection of the side plane 3221 and the arc surface 3222, the rotating member 32 is continued to rotate, and the two torsion arms are restored and gradually close together, so that the rotating member 32 is quickly rotated into position under the torsion force of the torsion spring 34, which increases the rotating feel and facilitates the user's operation.

Referring to FIGS. 5 and 9, in this embodiment, an abutting portion 331 is provided by protruding at one end of the locking member 33 away from the connecting pipe 121. The locking member 33 is provided with a deformation groove 332 adjacent to the abutting portion 331, the lower surface of the upper cover 12 extends downward to form a baffling plate 124 which is located at one side of the guiding groove 122 away from the mounting opening 1211. When the locking member 33 moves in a direction away from the connecting pipe 121 under the driving of the dustproof cover 31, the abutting portion 331 can abut against the baffling plate 124; due to the existence of the deformation groove 332, the plastic deformation ability of the part of the locking member 33 between the deformation groove 332 and the abutting portion 331 is improved, and forms a deformation space for the deformation of the locking member 33, so that the locking member 33 is plastically deformed. When the force applied at the dustproof cover 31 is released, the plastic deformation provides elastic force for the locking member 33 to promote the restoring of the locking member 33, and the dustproof cover 31 is restored under the driving of the locking member 33, which facilitates the user's operation. It can be understood that the locking member 33 is a deformable member. In this embodiment, the locking member 33 is made of plastic.

In addition, please refer to FIGS. 5 and 9, in this embodiment, the movable assembly 30 further includes a spring member 35 sleeved on the fixing column 123, the spring member 35 abuts against the base seat 321 of the rotating member 32. When the rotating member 32 is driven by the dustproof cover 31 to move away from the connecting pipe 121, the base seat 321 can press the spring member 35, and the spring member 35 is deformed; then the force applied at the dustproof cover 31 is released, the spring member 35 is restored, and then the base seat 321 and the dustproof cover 31 are pushed to restore. The restoring of the spring member 35 can further enhance the restoring ability of the dustproof cover 31 and is more convenient for the user to operate. It can be understood that the spring member 35 is made of silicone or rubber material.

Alternatively, in other embodiments not shown, the elastic member 25 can also be omitted, at this time, when the locking member 33 is disengaged from the locking groove 245, the user can manually pull out the inner tube 24 to clean the impurities on the inner tube 24.

In the present disclosure, the inner tube 24 can be closed by rotating the dustproof cover 31 to prevent dust, or the inner tube 24 can be opened by rotating the dustproof cover 31 so that the user can inhale the smoke. When the inner tube 24 is opened, sliding the dustproof cover 31 can release the locking relationship between the locking member 33 and the inner tube 24, and then the inner tube 24 can be taken out, which is convenient for the user to clean up impurities and is simple to operate, and it ensures the taste of smoking and improves the user experience.

The electronic cigarette 100 provided by the present disclosure has all the technical features of the above-mentioned atomizer, so it has the same technical effect as the above-mentioned atomizer.

The above embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. An atomizer, comprising:

a housing defining a mounting opening;

an atomizing assembly mounted in the housing, the atomizing assembly comprising an inner tube detachably mounted in the housing through the mounting opening, the inner tube being provided with a smoke outlet; and a movable assembly mounted to the housing, the movable assembly comprising a dustproof cover movably disposed on the housing and a locking member;

wherein the dustproof cover is rotatable relative to the locking member, rotating the dustproof cover can open the mounting opening to expose the smoke outlet or close the mounting opening to cover the smoke outlet, the inner tube is provided with a locking groove engaged with the locking member, when the dustproof cover opens the mounting opening and the dustproof cover is caused to slide, the locking member moves under the driving of the dustproof cover to disengage from the locking groove, such that the inner tube can be taken out from the housing.

2. The atomizer according to claim 1, wherein the housing comprises an upper cover, the mounting opening is defined in the upper cover, the upper cover further comprises a guiding groove, a connecting column is formed by extending downward from the lower surface of the dustproof cover, the connecting column extends through the guiding groove and is slidable in the guiding groove.

3. The atomizer according to claim 2, wherein the lower surface of the upper cover extends downward to form a baffling plate located at one side of the guiding groove away from the mounting opening, the locking member is a deformable member, one end of the locking member is protruded to provide an abutting portion capable of abutting against the baffling plate, the locking member is provided with a deformation groove adjacent to the abutting portion.

4. The atomizer according to claim 2, wherein the movable assembly further comprises a rotating member and a torsion spring, the connecting column extends through the guiding groove and the locking member in sequence and then connects with the rotating member, the rotating member comprises a boss located between two torsion arms of the torsion spring, the boss has a substantially waist-shaped structure, the boss has two oppositely arranged side planes and two oppositely arranged arc surfaces, the two torsion arms of the torsion spring are arranged parallel to the side planes.

5. The atomizer according to claim 4, wherein the lower surface of the upper cover extends downward to form a fixing column, the torsion spring is sleeved on the fixing column, the movable assembly further comprises a spring member sleeved on the fixing column, the rotating member further comprises a base seat connected to the boss, the base seat abuts against the spring member.

6. The atomizer according to claim 2, wherein the lower surface of the upper cover extends downward to form a connecting pipe that is open at both ends, the upper end of the connecting pipe extends through the upper surface of the upper cover, the mounting opening is formed by the opening of the upper end of the connecting pipe, the locking member extends through the connecting pipe to be engaged in the locking groove.

7. The atomizer according to claim 6, wherein the inner wall of the connecting pipe protrudes inwardly along the radial direction of the connecting pipe to form a first abutting edge, the upper end of the inner tube protrudes outwardly along the radial direction of the inner tube to form a second abutting edge, the second abutting edge abuts against the first abutting edge, the locking groove is defined at the outer side wall of the second abutting edge along the radial direction of the inner tube.

8. The atomizer according to claim 7, wherein the atomizing assembly further comprises a heating member, the inner tube is provided with an atomizing chamber, the atomizing chamber is in communication with the smoke outlet, the heating member is at least partially received in the atomizing chamber.

9. The atomizer according to claim 7, wherein the housing further comprises an outer casing, the upper cover is detachably provided at one end of the outer casing, a partition member is mounted in the outer casing, the atomizing assembly further comprises an outer tube and an elastic member, the outer tube is clamped between the partition member and the first abutting edge, the inner tube is movably received in the outer tube, the side wall of the outer tube is provided with a sliding slot along the axial direction of the outer tube, a clamping protrusion is provided at the side wall of the inner tube, the clamping protrusion is slidably received in the sliding slot, the elastic member is compressible and located between the clamping protrusion and the partition member.

10. An electronic cigarette, comprising an atomizer according to claim 1.

11. An atomizer, comprising:

a housing defining a mounting opening and a guiding groove located at one side of the mounting opening;

an atomizing assembly comprising an inner tube detachably mounted into the housing through the mounting opening; and a movable assembly comprising a dustproof cover mounted outside the housing and a locking member mounted inside the housing, a connecting column extending downward from the dustproof cover and inserted into the guiding groove, the inner tube being provided with a locking groove, the locking member being engaged in the locking groove to mount the inner tube in the housing;

wherein the dustproof cover is rotatable around the connecting column between a first state in which the mounting opening is exposed so that the inner tube is able to be detached from the housing through the mounting opening and a second state in which the mounting opening is covered by the dustproof cover;

wherein the connecting column is slidable in the guiding groove, when the dustproof cover is rotated to the first state to expose the mounting opening, the dustproof cover is caused to slide along the guiding groove in a direction away from the mounting opening and the dustproof cover drives the locking member to move and disengage from the locking groove, whereby the inner tube is capable of being taken out from the housing.

12. The atomizer according to claim 11, wherein the housing comprises an outer casing and an upper cover mounted at an upper end of the outer casing, the mounting opening and the guiding groove are defined in the upper cover.

13. The atomizer according to claim 12, wherein a baffling plate extends downward from the upper cover and is located at one side of the guiding groove away from the mounting opening, the locking member is deformable, one end of the locking member is engaged in the locking groove, and the other end of the locking member is provided with an abutting portion abutting against the baffling plate, the locking member is provided with a deformation groove located adjacent to the abutting portion.

14. The atomizer according to claim 12, wherein the movable assembly further comprises a rotating member and a torsion spring, the connecting column extends through the locking member and connects with the rotating member, a fixing column extends downward from the upper cover, the torsion spring is sleeved on the fixing column, the rotating member comprises a boss located between two torsion arms of the torsion spring, the boss has two oppositely arranged side planes and two oppositely arranged arc surfaces, the two torsion arms of the torsion spring are arranged parallel to the side planes.

15. The atomizer according to claim 14, wherein the movable assembly further comprises a spring member sleeved on the fixing column, the rotating member further comprises a base seat connected to the boss, the base seat abuts against the spring member.

16. The atomizer according to claim 12, wherein a connecting pipe extends downward from the upper cover and the connecting pipe is open at both ends, the mounting opening is formed by the opening of the upper end of the connecting pipe, the inner tube is received in the connecting pipe and the locking member extends through the connecting pipe to be engaged in the locking groove.

17. The atomizer according to claim 16, wherein the inner wall of the connecting pipe protrudes inwardly along the radial direction of the connecting pipe to form a first abutting edge, the upper end of the inner tube protrudes outwardly along the radial direction of the inner tube to form a second abutting edge, the second abutting edge abuts against the first abutting edge, the locking groove is defined at the outer side wall of the second abutting edge along the radial direction of the inner tube.

18. The atomizer according to claim 17, wherein a partition member is mounted in the outer casing, the atomizing assembly further comprises an elastic member, the elastic member is compressible with one end thereof being abutting against the inner tube and the other end thereof being abutting against the partition member.

19. The atomizer according to claim 18, wherein the atomizing assembly further comprises an outer tube clamped between the partition member and the first abutting edge, the inner tube is received in the outer tube, the side wall of the outer tube is provided with a sliding slot along the axial direction of the outer tube, a clamping protrusion is provided at the side wall of the inner tube, the clamping protrusion is received in the sliding slot, the elastic member is sandwiched between the clamping protrusion and the partition member.

20. The atomizer according to claim 11, wherein an upper end of the inner tube is provided with a smoke outlet, an inner cavity of the inner tube forms an atomizing chamber in communication with the smoke outlet, and a heating member is at least partially received in the atomizing chamber.

* * * * *